US006566799B1

(12) United States Patent
Ragland, Jr.

(10) Patent No.: US 6,566,799 B1
(45) Date of Patent: May 20, 2003

(54) CATHODE RAY TUBES HAVING DAMPER WIRE SUPPORT SPRINGS

(75) Inventor: Frank Rowland Ragland, Jr., Lancaster, PA (US)

(73) Assignee: Thomson Licensing, S.A., Boulogne-Billancourt (FR)

( * ) Notice: Subject to any disclaimer, the term of this patent is extended or adjusted under 35 U.S.C. 154(b) by 0 days.

(21) Appl. No.: 09/999,016

(22) Filed: Nov. 15, 2001

(51) Int. Cl.[7] ..... H01J 29/02
(52) U.S. Cl. ..... 313/407; 313/402; 313/404
(58) Field of Search ..... 313/402, 403, 313/404, 405, 407

(56) References Cited

U.S. PATENT DOCUMENTS

| | | | | |
|---|---|---|---|---|
| 4,780,641 A | | 10/1988 | Hashiba et al. | 313/269 |
| 5,382,871 A | | 1/1995 | Funahashi et al. | 313/402 |
| 5,394,051 A | | 2/1995 | Lerner | 313/403 |
| 5,542,868 A | * | 8/1996 | Kozuka et al. | 445/37 |
| 6,043,803 A | | 4/2000 | Saita | 313/402 |

FOREIGN PATENT DOCUMENTS

| | | | | |
|---|---|---|---|---|
| JP | 5062608 | * | 3/1993 | 313/402 |
| JP | 5128980 | * | 5/1993 | 313/402 |

* cited by examiner

*Primary Examiner*—Ashok Patel
(74) *Attorney, Agent, or Firm*—Joseph S. Tripoli; Carlos M. Herrera; Reitseng Lin

(57) ABSTRACT

A cathode ray tube has a tensioned mask supported by a support frame. The tension mask being susceptible to vibration and adapted for mounting in tension within the cathode ray tube. The tension mask includes damper wire support springs attached to, and extending from, opposite sides of the tension mask support frame. The damper wire support springs having a compliance section supporting a damper wire in contact with and across the surface of the tension mask for damping vibrations in the mask.

7 Claims, 2 Drawing Sheets

CATHODE RAY TUBES HAVING DAMPER WIRE SUPPORT SPRINGS

FIELD OF THE INVENTION

This invention generally relates to cathode ray tubes and, particularly, to an improved means for damping vibrations in such tubes having a tension mask.

BACKGROUND OF THE INVENTION

As is known in the art, a cathode ray tube is generally constructed of a glass envelope and includes an electron gun located within a neck portion of the envelope for generating and directing three electron beams to the screen of the tube. The screen is located on the inner surface of a faceplate panel of the tube and is made up of an array of elements of three different color emitting phosphors. A color selecting electrode, which may be either a shadow mask or a focus mask, is interposed between the gun and the phosphor screen to permit each electron beam to strike only the phosphor elements associated with that beam. Each electron beam is scanned by an electromagnetic deflecting device for impingement on a desired phosphor of the phosphor screen.

In conventional color cathode ray tubes having two-dimensionally curved color selecting electrodes or shadow masks, the curvature of the mask and its thickness causes it to be structurally self-supporting. Another type of commercial shadow mask is tensioned on a support frame and is not self-supporting as is the two-dimensionally curved type. The tension shadow mask contains a plurality of very thin parallel vertically extending strands maintained at high tension. In another type of tension mask, the frame supporting the mask is designed to permit the mask to de-tension during thermal treatment of the tube. The afore-described cylindrical tension shadow mask configurations are prone to vibrations, as may be caused by external mechanical pulses, or by a speaker in an associated television receiver, for example. The resonant frequency of vibration of the mask will vary depending on the mechanical parameters of and tension in the mask. Any vibration of the mask will cause electron beam landings to be out of registry with their respectively associated phosphor elements, causing color impurities in the reproduced images.

Various means have been suggested for damping the resonant vibrations described above. One example for damping the vibration of a tension mask includes damping wires stretched across the mask to damp vibrations in the mask strands by relative motion between the strands and the wires. The damping wires can be held against the mask strands because of the curved nature of the mask. The ends of the wires are secured to the frame supporting the tension mask by tabs which hold the wires under light tension. With such an arrangement, the strands are resiliently pressed by the wires and, therefore, are not likely to vibrate by external mechanical shocks or electron beam bombardment. Disadvantages inherent in a mask assembly of this type include variations in the height of the tabs which could either cause the wires not to touch the strands or press on them to cause noticeable deflection of the strands so as to prevent damping of their motions. The problem is exacerbated by the use of tension masks having specific tension distributions across the mask or in de-tension mask frames resulting in relatively low strand stretching forces.

This invention is directed to providing a solution to the problem of damping resonant vibrations in a tension shadow mask and thus avoiding a deterioration of picture quality caused by external vibrations.

SUMMARY OF THE INVENTION

The present invention provides a cathode ray tube having a color selection electrode tension mask attached to a support frame. The tension mask includes damper wire support springs attached to, and extending from, opposite sides of the tension mask support frame. The damper wire support springs having a compliance section supporting a damper wire in contact with and across the surface of the tension mask for damping vibrations in the mask.

BRIEF DESCRIPTION OF THE DRAWINGS

Further features and advantages of the present invention may best be understood by reference to the following description of preferred embodiments of the invention taken in conjunction with the accompanying drawings, in the figures of which like reference numerals identify like elements, and in which.

DETAILED DESCRIPTION OF THE PREFERRED EMBODIMENT

Figure 1:
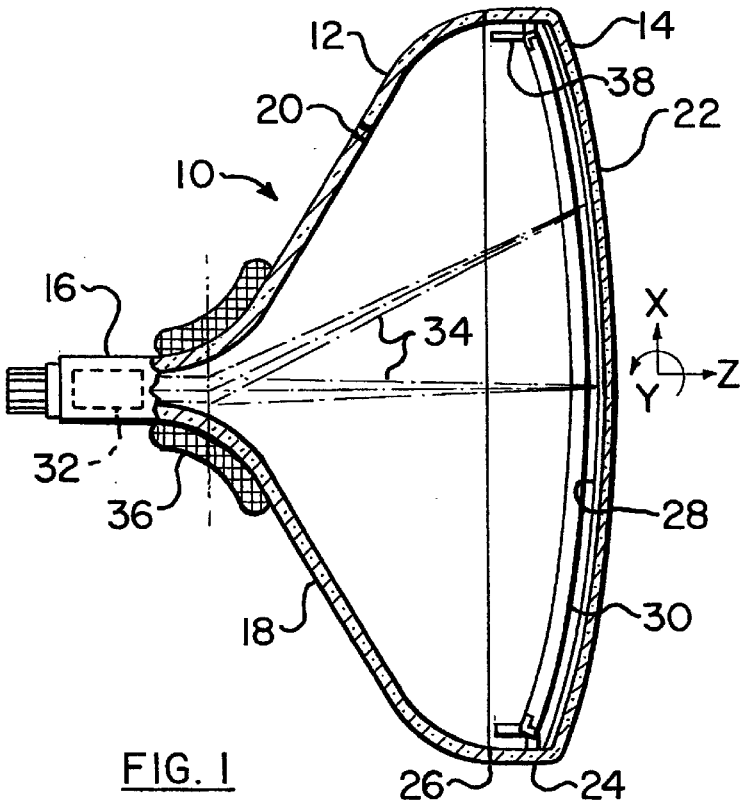
FIG. 1 is a top view, partly in axial section, of a color picture tube embodying the invention.

FIG. 1 shows a color picture tube 10 having a glass envelope 12 comprising a rectangular faceplate panel 14 and a tubular neck 16 connected by a rectangular funnel 18. The funnel 18 has an internal conductive coating (not shown) that extends from an anode button 20 to the wide portion of the funnel and to the neck 16. The panel 14 comprises a substantially flat external viewing faceplate 22 and a peripheral flange or sidewall 24, which is sealed to the funnel 18 by a glass frit 26. A three-color phosphor screen 28 is carried by the inner surface of the faceplate 22. The screen 28 is a line screen with the phosphor line arranged in triads, each triad including a phosphor line of each of the three colors. A color selection electrode or tension shadow mask 30 is removably mounted in predetermined spaced relation to the screen 28. An electron gun 32, shown schematically by dashed lines in FIG. 1, is centrally mounted within the neck 16 to generate and direct three inline electron beams 34, a center beam and two side beams, along convergent paths through the mask 30 to the screen 28.

The tube 10 is designed to be used with an external magnetic deflection yoke, such as the yoke 36 shown in the neighborhood of the funnel-to-neck junction. When activated, the yoke 36 subjects the three beams to magnetic fields which cause the beams to scan horizontally and vertically in a rectangular raster over the screen 28.

Figure 2:
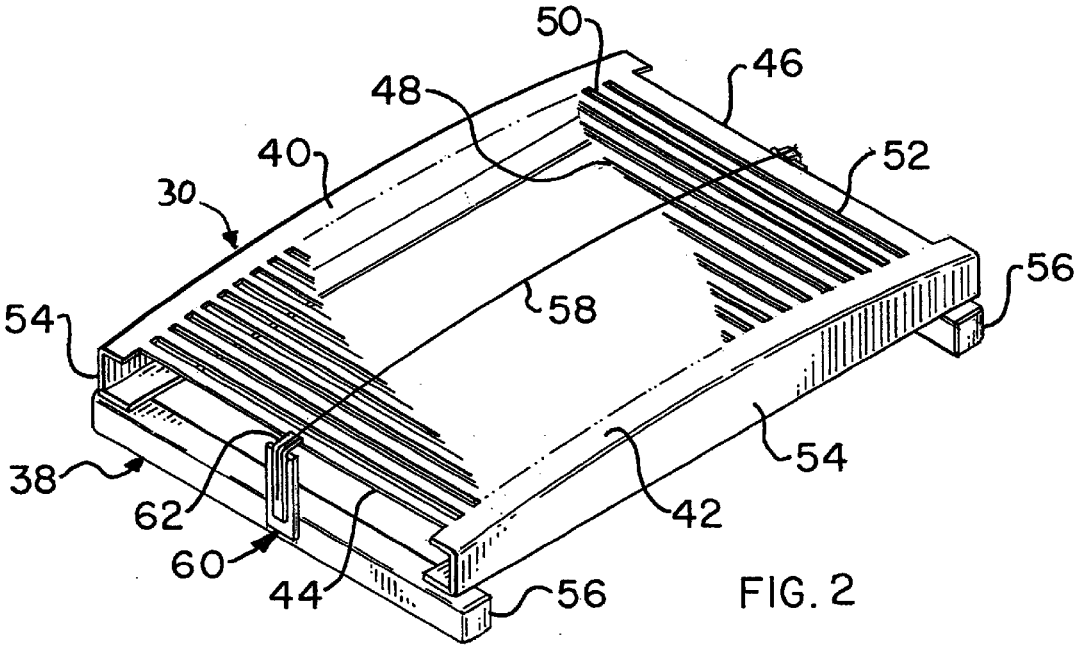
FIG. 2 is a perspective view showing an embodiment of the damper wire support springs on a tension mask and support frame according to the present invention.

FIG. 2 is a perspective view of the tension mask 30 mounted on a frame 38. The tension mask 30 includes two long sides 40 and 42, and two short sides 44 and 46. The two long sides 40 and 42 of the tension mask parallel the central major axis, X, of the tube; and the two short sides 44 and 46 parallel the central minor axis, Y, of the tube. The tension mask 30 includes an active apertured portion 48 that contains a plurality of parallel vertically extending strands 50. A multiplicity of elongated apertures 52, between the strands 50, parallel the minor axis Y of the tube. The electron beams pass through the apertures 52 in the active apertured portion 48 during tube operation.

The frame 38 includes four sides: two long sides 54, substantially paralleling the major axis X of the tube, and two short sides 56, paralleling the minor axis Y of the tube. A damper wire 58 extends across the tension shadow mask 30 perpendicular to the apertures 52. Damper wire support springs 60 are secured to and extend from the short sides 56 of the frame 38 on the outside peripheral portion of the tension shadow mask 30. The damper wire support springs 60 include compliance section 62 supporting the damper wire 58 on the screen side of the tension shadow mask 30 in contact with the strands 50 of the tension shadow mask 30 for damping vibrations in the mask.

Figure 3:
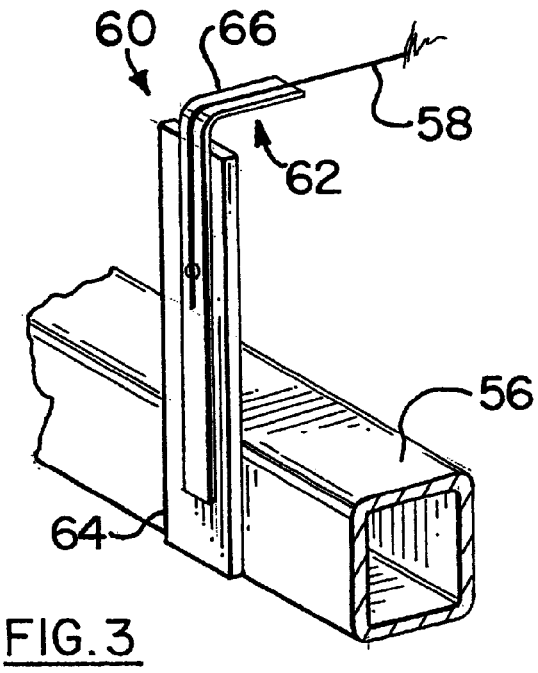
FIG. 3 is a detail view in perspective of a representative one of damper wire support springs according to the invention.

FIG. 3 is a view of the damper wire support spring 60 for a tension mask according to the invention. The damper wire support spring 60 includes a holding member 64 for securing the damper wire support spring 60 to the short sides 56 of the frame 38 and a compliance section 62 for supporting the damper wire 58 in contact with the strands 50 (as shown in FIG. 2). The compliance section 62 is a relatively thin spring member 66 secured to the free end of the holding member 64. The spring member 66 extends from the free end of the holding member 64 and curves inward in a bias position toward the central active apertured portion 48 of the tension shadow mask 30 (as shown in FIG. 2). Attached to the spring member 66 is the damper wire 58, by spot welding for example, whereby the damper wire 58 is held in position between the damper wire support springs 60 and against the strands 50 such that it is permitted a degree of "play" or movement, referred herein to as "compliance," in response to mask pre-loading or side-loading forces. It will be understood that the damper wire 58 may also be attached to the holding member 64, by spot welding for example, so long as the damper wire 58 is supported by the compliance section 62.

The damper wire support spring 60 is manufactured by forming separately the holding member 64 and the spring member 66 and then combining them with each other so that the dimensions of each portion can be set individually according to the required compliance. In a preferred embodiment, the spring member 66 is made from a suitable material having a thickness in the range of about 0.001 to 0.003 inches (0.25–0.76 mm) and a width of about 0.05 to 0.20 inches (12.7–50.8 mm) to permit compliance of the damper wire 58 in the direction normal to the mask, or X–Y plane of the tube, as well as compliance in the direction tangent to the surface of the tension shadow mask 30. It will be appreciated, of course, that the spring member 66 might also be constructed with alternative dimensions if desired.

Figure 4:
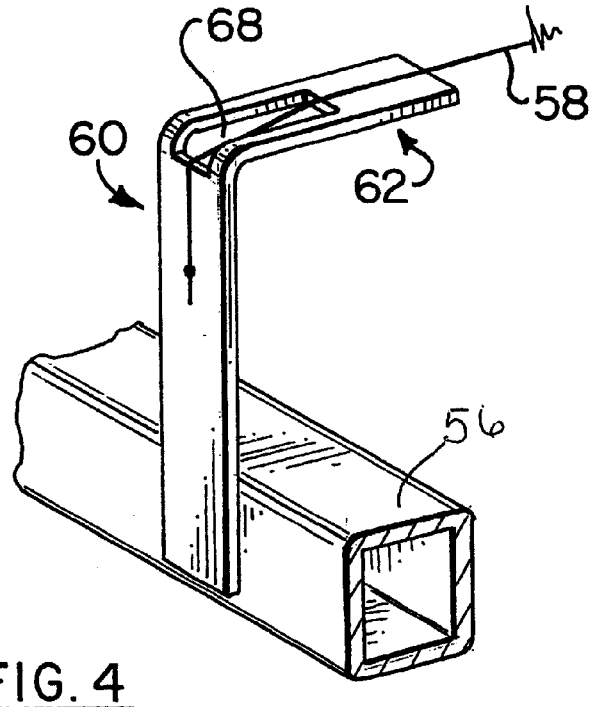
FIG. 4 is a view similar to FIG. 3 depicting an alternative embodiment of the damper wire support springs.

FIG. 4 is a depiction of another embodiment of the present invention. In this embodiment, the compliance section 62 of the damper wire support spring 60 supporting the damper wire 58 is of a unitary construction with an L-shaped section having a cut out region 68. The damper wire support spring 60 is formed from a single sheet of material and the cut out region 68 is introduced in a condition so that the compliance on the damper wire 58 becomes substantially the same as achieved by the embodiment shown in FIG. 3. With the cut out region 68, however, the damper wire 58 is not carried by the bent contour and spring bias of the spring member 66 as shown in FIG. 3, but rather works to apply a pre-load force on the free end of the damper wire support spring 60 for compliance. In either embodiment, the compliance of the damper wire support spring 60 secures the damper wire across the mask to the strands 50 such that the damper wire is free to move somewhat in response to forces associated with variations in the deflections and tension distribution in the mask.

According to the present invention, the compliance provided by the vibration damping means maintains the effectiveness of the damper wire in spite of significant changes in the resonant frequency of the tension mask which may result from heating and cooling of the mask or from external mechanical shocks to the tube. Even if the tension distribution across the mask results in relatively low strand stretching forces, the damper wire support spring 60 provides compliance in the damper wires 58 to maintain contact with the strands 50. Consequently, the deterioration of picture quality caused by external vibration or thermal cycles can be prevented.

While the present invention has been described with reference to one or more particular embodiments, those skilled in the art will recognize that many changes may be made thereto without departing from the spirit and scope of the present invention. For example, the number of damper wire support springs 60 may be increased to support additional damper wires so as to provide sufficient dampening of the tension mask. Each of these embodiments and obvious variations thereof is contemplated as falling within the spirit and scope of the claimed invention, which is set for the in the following claims.

What is claimed is:

1. A cathode ray tube having a tension mask attached to a support frame mounted within the tube, said tension mask comprising damper wire support springs attached to and extending from opposite sides of said support frame, said damper wire support springs further comprising a compliance section; and, a damper wire supported by said compliance section of said damper wire support springs whereby the damper wire is in contact with the surface of the tension mask, wherein said damper wire support springs comprise a holding member secured to and extending from opposite sides of said support frame and supporting said compliance section.

2. The cathode ray tube as defined in claim 1, wherein said compliance section is a spring member secured to the free end of said holding member.

3. A cathode ray tube having a tension mask attached to a support frame mounted within the tube, said tension mask comprising damper wire support springs attached to and extending from opposite sides of said support frame, said damper wire support springs further comprising a compliance section; and, a damper wire supported by said compliance section of said damper wire support springs whereby the damper wire is in contact with the surface of the tension mask, wherein each of said damper wire support springs is a unitary construction having a cut out region therein accommodating compliance of said compliance section.

4. A cathode ray tube having a tension mask attached to a support frame mounted to a faceplate within the tube, said tension mask having a screen side and an electron gun side, said tension mask comprising an active apertured portion formed by a plurality of parallel vertically extending strands, between which are elongated apertures through which electron beams pass during operation of said tube;

a damper wire support spring attached to and extending from opposite side border portions of said support frame outside said active portion, said damper wire support spring further comprising a compliance section; and, a damper wire extending between and supported by said compliance section to the screen side of said tension mask, wherein said damper wire support spring comprises a holding member secured to and extending from said opposite side border portions and supporting said compliance section.

5. The cathode ray tube as defined in claim 4, wherein said compliance section is a spring member secured to said holding member and extending inwardly in a bias position toward said active apertured portion.

6. The cathode ray tube as defined in claim 5, wherein said spring member and said holding member being compliant relative to each other.

7. A cathode ray tube having a tension mask attached to a support frame mounted to a faceplate within the tube, said tension mask having a screen side and an electron gun side, said tension mask comprising an active apertured portion formed by a plurality of parallel vertically extending strands, between which are elongated apertures through which electron beams pass during operation of said tube;

a damper wire support spring attached to and extending from opposite side border portions of said support frame outside said active portion, said damper wire support spring further comprising a compliance section; and, a damper wire extending between and supported by said compliance section to the screen side of said tension mask, wherein said damper wire support spring is of a unitary construction having a cut out region therein accommodating compliance of said compliance section.

* * * * *